United States Patent [19]

Matsuda

[11] Patent Number: 4,788,086

[45] Date of Patent: Nov. 29, 1988

[54] COPPER-BASED METALLIC MEMBER HAVING A CHEMICAL CONVERSION FILM AND METHOD FOR PRODUCING SAME

[75] Inventor: Shigeki Matsuda, Okazaki, Japan

[73] Assignee: Nippondenso Co., Ltd., Kariya, Japan

[21] Appl. No.: 754,231

[22] Filed: Jul. 12, 1985

[30] Foreign Application Priority Data

| | | | |
|---|---|---|---|
| Jul. 14, 1984 | [JP] | Japan | 59-146499 |
| Aug. 11, 1984 | [JP] | Japan | 59-168238 |
| Sep. 7, 1984 | [JP] | Japan | 59-188673 |

[51] Int. Cl.[4] ..... B65D 65/28

[52] U.S. Cl. ..... 428/34.1; 428/389; 428/469; 428/704; 148/6.15 R; 148/6.15 Z; 148/6.16

[58] Field of Search ..... 428/704, 469, 389, 36; 148/6.15 R, 6.15 Z, 6.16

[56] References Cited

U.S. PATENT DOCUMENTS

| | | | |
|---|---|---|---|
| 2,233,422 | 6/1938 | Lodeesen | 148/6.15 R |
| 2,272,216 | 2/1942 | Lodeesen | 148/6.15 R |
| 2,514,149 | 7/1950 | Amundsen | 148/6.15 Z |
| 3,116,178 | 12/1963 | Upham | 148/6.15 Z |
| 3,364,081 | 1/1968 | Forsberg | 148/6.15 R |
| 3,677,828 | 7/1972 | Caule | 148/6.15 R |
| 3,764,400 | 10/1973 | Caule | 148/6.16 R |
| 3,833,433 | 9/1974 | Caule | 148/6.16 |
| 3,837,929 | 9/1974 | Caule | 148/6.16 |
| 4,004,064 | 1/1977 | Kessler | 428/704 |
| 4,026,734 | 5/1977 | Manty | 148/6.15 R |
| 4,070,193 | 1/1978 | Tucker | 148/6.21 |
| 4,075,040 | 2/1978 | Villain | 148/6.14 R |
| 4,165,242 | 8/1979 | Kelly et al. | 148/6.15 Z |
| 4,264,379 | 4/1981 | Caule | 148/6.15 R |
| 4,312,922 | 1/1982 | Caule | 148/6.15 R |
| 4,521,469 | 6/1985 | Butt et al. | 148/6.15 R |

FOREIGN PATENT DOCUMENTS

| | | | |
|---|---|---|---|
| 169047 | 1/1986 | European Pat. Off. | 428/469 |
| 129741 | 8/1982 | Japan | 428/469 |
| 393070 | 6/1933 | United Kingdom . | |
| 863304 | 8/1957 | United Kingdom . | |

OTHER PUBLICATIONS

Metal Surface Treatment, Chemical and Electrochemical Surface Conversions, Gutcho, 1982, pp. 379–383.

*Primary Examiner*—Sharon A. Gibson

*Attorney, Agent, or Firm*—Cushman, Darby & Cushman

[57] ABSTRACT

Copper can be directly chemically converted by the disclosed method and a novel copper-based metallic member is proposed. The chemical conversion film formed on the copper-based metallic member comprises phosphate and copper halide. The chemical conversion bath contains metal ions, phosphoric acid ions, halogen ions, and oxidizer.

8 Claims, 11 Drawing Sheets

COPPER-BASED METALLIC MEMBER HAVING A CHEMICAL CONVERSION FILM AND METHOD FOR PRODUCING SAME

BACKGROUND OF THE INVENTION

1. Field of Invention

The present invention relates to a copper-based metallic member haaving a chemical conversion phosphate film, particularly an insulated copper-electric wire, and to a method for forming a chemical conversion phosphate film, such as a zinc phosphate film, on a copper-based metallic member. More particularly, the present invention relates to a copper-based metallic member having an improved rust-proofing characteristic, and an improved lubrication characteristic at press forming. In addition, the present invention relates to an electric copper wire with insulation which is used for wires including a coil-winding for converting electric power to magnetic energy, wire for an electric power transmission, cabtyre cable and cords, and relates to a method for forming a chemical conversion film having an electric-insulation characteristic and a lubrication characteristic.

2. Description of the Related Art

It is known to subject iron-based material to a chemical conversion treatment to form a zinc phosphate film or a zinc chromic acid film on the surface of the material. Iron-based material undergoing the chemical conversion treatment has excellent characteristics enabling it to be used in various fields. On the other hand, since copper is chemically stable, it was heretofore difficult to apply the chemical conversion treatment, such as used for the iron-based material, to copper-based metallic members. The known chemical conversion treatments for copper-based metallic members are different from those for iron-based material. In one such treatment, a copper-based metallic member is treated in an aqueous solution containing potassium chlorate or potassium per chlorate at a temperature of from 80° C. to 90° C. for a period of 5 to 10 minutes, thereby obtaining a copper-based metallic member having a cuprous oxide film. In another such treatment, a copper-based metallic member is treated in an aqueous solution containing sodium hydroxide and potassium persulfate, thereby obtaining a copper-based metallic member having a cupric oxide film. The former method is referred to as the cuprous-oxide method, and the latter method is referred to as the black copper-oxide method.

It is also known to treat copper-based metallic member with chromic acid.

The copper-based metallic member having the copper oxide film is less reactive than the chemically converted iron-based material, and therefore, any coating thereon does not exhibit excellent properties. Furthermore, the procedures for the known chemical conversion treatments for a copper-based metallic member are complicated. Accordingly, the known chemical conversion treatments for copper have been limited in use.

In this connection, a phosphate film has a high reactivity and is preferable. Where a phosphate film is necessary as, for example, an undercoat for another coating, zinc is galvanized on the copper-based metallic member, and is then treated by the phosphating process. This causes problems in the operating efficiency, cost, and the like.

Heretofore, copper electric wires with insulation were produced by applying insulating coating on the copper electric-wire base and baking the insulating coating (a synthetic enamel wire); winding an insulating fiber around the copper electric-wire base (a fiber-wound wire); or, combining these methods to form a composite insulation. These copper electric wires are widely used in generators, motors, transformers, and the like.

Along with a recent tendency toward enhancing the capacity and voltage and minutuarizing of electric machinery and devices, electric devices and the like in automobiles are required to withstand strict environmental and operating conditions. The conventional copper electric-wires used in such electric devices are therefore required to have excellent insulation characteristics. In order to meet such a requirement, the chemical conversion film cannot be utilized because such a film having a good reactivity cannot be directly and firmly formed on the copper surface, instead, one or two layers of organic insulating material, which are directly deposited or coated on the copper electric-wire, are utilized. The layer(s) of organic insulating material have therefore the disadvantage in that they are easily damaged during the coiling necessary in the production of an electric wire, so that current leakage through the damaged layer(s) occurs. In the case of a synthesized enamel wire, when the film has been stretched or bent and then comes into contact with water or a solvent, an abnormality referred to as "crazing" occurs in which apparently minute cracks are formed in the film.

SUMMARY OF THE INVENTION

It is an object of the present invention to provide a copper-based metallic member having a chemical conversion film comprising phosphate.

It is another object of the present invention to provide a method for overcoming the problem wherein, due to the lower ionization tendency of copper to that of hydrogen, a copper-based metallic member cannot be phosphatized by the same method used for phosphatizing steel materials, to thereby form a chemical conversion film on copper materials.

It is a further object of the present invention to provide an insulated electrical conductor having an improved heat resistance and an improved adhesion characteristic.

In accordance with the objects of the present invention, there is provided a copper-based metallic member having a chemical conversion film formed on at least a part of the surface thereof and comprising a phosphate and copper halide.

The insulated electrical copper-conductor according to the present invention comprises: a conductor in a plate, tubular or wire form, consisting of copper; a chemical conversion film formed on at least a part of the conductor and comprising a phosphate and a copper halide; and, an insulating coating formed on at least the chemical conversion film.

The present invention also provides a method for forming a chemical conversion film on the surface of a copper-based metallic member, characterized in that this member is brought into contact with a chemical conversion bath containing phosphoric acid ions, metal ions which are present in an aqueous solution as a stable dihydrogen phosphate compound with the phosphoric acid ions and which decreases its solubility, halogen ions except for fluorine ions, and an oxidizer which promotes the dissolving of copper in an acidic solution, thereby forming on the surface of a copper-based material a film comprising phosphate and copper halide.

The copper-based material of the present invention is copper or a copper alloy, and the shape thereof is not specifically limited. The chemical conversion according to the present invention is applied to the copper-based material having virtually any shape, from a simple shape, such as sheet, rod or wire, to a complicated shape, such as a formed article.

According to the present invention, the phosphate, one of the components constituting the chemical conversion film, is at least one member selected from the group consisting of zinc phosphate, manganese phosphate, iron phosphate, calcium phosphate, and magnesium phosphate. The copper halide, as the other component constituting the chemical conversion film, is at least one member selected from the group consisting of copper chloride, copper bromide, and copper iodide. The copper halide is preferably cuprous halide having a small solubility product.

The chemical conversion film according to the present invention is formed by means of placing the copper-based material in contact with the chemical conversion bath containing the phosphate ions, metal ions, and halogen ions, and allowing reactions to occur between the above ions and copper at normal temperture. The dipping or spraying method is used to bring the material and bath into contact with one another. The chemical conversion film, which is either crystalline or amorphous, is protective and has other properties required for the intended use. The thickness of a chemical conversion film can be varied depending upon the property required for such a film. The thickness of the film used in lubricating treatment is preferably from 2 μm to 30 μm. Note, the thickness of the film for a wire is preferably thinner. The chemical conversion film may be formed entirely or locally on the surface of a copper-based material substrate. According to examples of the local formation, the chemical conversion film is formed on the inner surface of a copper pipe or is formed only on a groove or recess of a grooved or recessed copper-based material substrate.

BRIEF DESCRIPTION OF THE DRAWINGS

The present invention is further described with reference to the drawings, in which.

DESCRIPTION OF THE PREFERRED EMBODIMENTS

Figure 1:
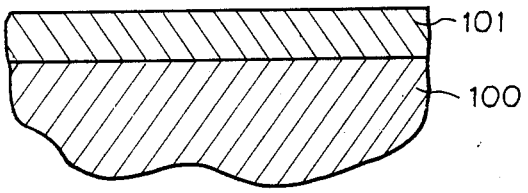
FIG. 1 is a schematic cross-sectional view of the copper-based metallic member according to the present invention.

Referring to FIG. 1, the copper-based metallic member according to the present invention has a chemical conversion film 101 formed directly on the copper-based metallic substrate 100.

The chemical conversion bath used in the present invention contains phosphate ions, metal ions, halogen ions and an oxidizer.

The components of the chemical conversion bath according to the present invention are a main agent comprising the metal ions, halogen ions, and phosphoric acid ions (hereinafter referred to, collectively as "the main agents-components"), and an auxiliary agent comprising an oxidizer. The chemical conversion bath contains the main and auxiliary agents as dissolved in the water. When the copper-based materials are placed in contact with the chemical conversion bath composed according to the present invention, a chemical conversion film is formed on the contact surface of the copper-based material in the successive procedures described hereinafter, according to the general corrosion reaction of the copper-based metallic substrate 100.

The metal ions contained in the chemical conversion bath may be zinc, manganese, iron, calcium, magnesium, and the like. These are present in the aqueous solution as stable dihydrogen phosphate compounds, as in the case of chemical conversion for steel. The above-mentioned and other metal ions are used in the chemical conversion bath, provided that their solubility greatly decreases upon the dehydrogenation reaction shown in formula (1).

$$xM(H_2PO_4)_y \rightarrow Mx(PO_4)_y + 2\ yH^+ \quad (1)$$

For the halogen ions, those halogen ions having a cuprous salt which exhibits a satisfactorily low solubility product can be used for one of the bath components. Preferably chlorine (Cl), bromine (Br) and iodine (I) are used. Because fluorine (F) has a greater electronegativity than oxygen, its behavior in the aqueous solution is clearly different to the other halogens having a smaller electronegativity than oxygen. Therefore, it is difficult to use fluorine as one of the bath components.

For the oxidizer, it is possible to use a component which promotes the dissolution of copper in an acidic solution and which per se carries out a reduction reaction. Thus hydrogen peroxide and nitrite ions, participating in the reduction reactions (4) and (5) below, respectively, can be used as the oxidizer. Bichromate ions also can be used.

$$Cu \rightarrow Cu^{+} + e \quad (2)$$

$$Cu^{+} \rightarrow Cu^{2+} + e \quad (3)$$

$$H_2O_2 + 2H^{+} + 2e \rightarrow 2H_2O \quad (4)$$

$$NO_2 + 2H^{+} + e \rightarrow H_2O + NO\uparrow \quad (5)$$

Formulas (2) and (3) represent the anode reactions, and the formulas (4) and (5) represent the cathode reactions in which the oxidizer participates. Since the electrode potential of formulas (4) and (5) appears to be higher than that of formulas (2) and (3), the copper of a copper-head metallic member dissolves into the solution.

Since the oxidizers react in the acidic solution of a chemical conversion bath, as represented by formulas (4) and (5), to consume the electrons (e), the reactions (2) and (3) proceed and hence the copper dissolves. The anode reaction (dissolution of copper and other oxidizing reactions) and the cathode (reduction) reaction occur concurrently on the identical sites of the surface of a copper-based material in contact with the chemical conversion bath.

The reactions for forming a film are explained for the case wherein the metal ions are zinc, and the halogen ions are chlorine. Formulas (6) and (7) or (7') represent the anode and cathode reactions, respectively, in the direct proximity of the surface of the copper-based material. As a result, colloid particles of zinc phosphate and cuprous chloride having a small solution product are formed and coagulate on the surface of the copper-based material to form a film.

$$3Zn^{2+} + 2H_2PO_4^{-} \rightarrow Zn_3(PO_4)_2\downarrow + 4H^{+} \quad (6)$$

$$Cu^{2+} + Cl^{-} + e \rightarrow CuCl\downarrow \quad (7)$$

The reactions (2), (3), and (7) can be expressed as:

$$Cu + Cl^{-} \rightarrow CuCl + e \quad (7')$$

This reaction indicates that cupric ions are not formed during the formation of CuCl. Either the three reactions (2), (3) and (7) or the reaction (7') occurs in the bath, possibly the reaction (7') predominantly occurs in the bath.

$$H_3PO_4 \rightarrow H^{+} + H_2PO_4 \quad (8)$$

$$2H^{+} + 2e \rightarrow H_2\uparrow \quad (9)$$

When the bath temperature is high in the reactions for forming a chemical conversion film described above, the dissociation reaction of phosphoric acid under the reaction (8) and the reactions (6) and (9) to generate hydrogen gas occasionally occur, and disadvantageously result in the formation of sludge. Therefore, the temperature of the bath or chemically converting the copper surface is preferably maintained at 40° C. or less, more preferably, 20° C. to 30° C.

In order that the formation reactions of phosphate and cuprous halide can be utilized in an ordinary production line, the reaction speed must be satisfactorily high. Regarding the electrode reaction, the factors participating in determination of the reaction speed are the concentration of the reaction-participate matters, temperature, pressure, and electrode potential. The higher the temperature, the higher the reaction speed. A low temperature is preferred, to suppress the hydrogen generation according to formula (9). This pressure is a constant atmospheric pressure in the dipping type chemical conversion bath. A somewhat high pressure is preferred in the spray type chemical conversion. Regarding the concentration of the reactions for the dissolution reaction, such as oxidizer, e.g., hydrogen peroxide, and hydrogen ions, a high concentration is preferred. The hydrogen-ion concentration must be less than a certain value in the formation reactions of a film. Regarding the electrode potential, the reaction potential of the oxidizer (cathodic reaction potential) must be greater than the reaction potential of the copper dissolution (anode potential).

From the consideration discussed above, to proceed with the formation reactions of a phosphate film by electrochemical reactions, the following two requirements must be met:

(a) The workpiece and the treatment bath are combined in such a manner that the workpiece dissolution proceeds at a satisfactorily high speed at normal temperature; and, (b) The main agent, oxidizer, and hydrogen ions, i.e., the participates of the formation reactions of the film, are maintained at a concentration range such that a phosphate film can be formed at normal temperature.

Preferably, at least 2 g of phosphoric acid ions, at least 2 g of metal ions, such as zinc and the like, and at least 1 g of halogen ions, such as chlorine ions, are preferably contained in a 1 l chemical conversion bath according to the chemical conversion method of the present invention. The above requirements (a) and (b) are satisfied in the chemical conversion bath composed as above, when the pH range is from 0.5 to 3.5 and the oxidizer concentration in terms of oxidation-reduction potential (electrode potential of silver chloride) is in the range of from 550 to 1000 mV. In the method according to the present invention, the copper dissolution is not assisted by the temperature because the bath temperature is low. The pH range of 0.5 to 3.5 is determined to provide a high hydrogen concentration and to advance the copper dissolution notwithstanding the low bath temperature. The pH measured at a low temperature tends to be low, and the pH herein is the value measured at the treating temperature of the bath.

As described above, oxidizer in a concentration greater than a certain value is necessary for advancing the copper-dissolution reaction at a low pH or a high hydrogen-ion concentration. Such as oxidizer concentration is in the range of from 550 to 1000 mV in terms of the oxidation-reduction potential (silver-chloride electrode). When the oxidizer concentration is less than 550 mV of the oxidation-reduction potential, the film formation is retarded or the film is not formed. On the other hand, when the oxidizer concentration is more than 1000 mV in terms of the oxidation-reduction potential, an excess amount of oxidizer contributes virtually nothing to the reactions.

In the method according to the present invention, the main agent- and oxidizer-concentrations decrease in the treatment bath in accordance with the development of the film-formation, with the result that the pH and oxidation-reduction potential vary in the treating bath. The pH variance is co-related to variation of the main-agent concentration, in such a manner that the pH of the treating bath rises with a decrease in the main agent-concentration. To ensure a stable chemical conversion treatment, the pH of the treating bath is periodically or continuously measured and the components of the main agent replenished at a pH of more than the predetermined value.

Figure 2:
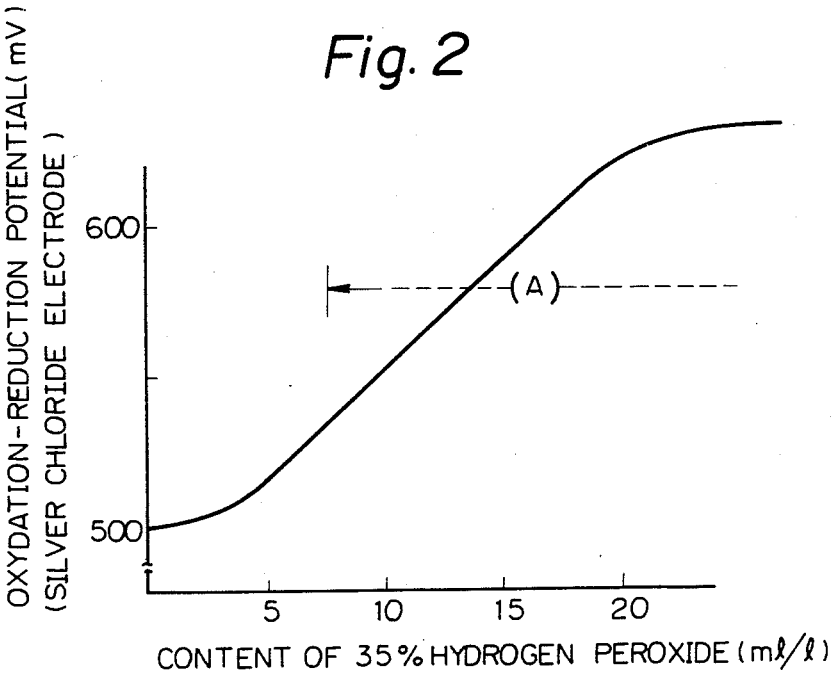
FIG. 2 is a graph indicating a relationship between the oxidation reduction potential (silver chloride electrode) and the concentration of 35% hydrogen peroxide.

The oxidation-reduction potential varies depending upon the oxidizer concentration, as shown in FIG. 2. The bath tested to obtain the graph as shown in FIG. 2 contained 67 g/l of phosphoric acid-ions, 80 g/l of zinc ions, and 63 g/l of chlorine ions, and had a volume of 180 l, a temperature of 20° C. to 30° C., and a pH of 1.4. The content of 35% hydrogen peroxide was added to the bath in the amounts given in the abscissa. The oxidation-reduction potential shown in the ordinate increases almost proportionally to the increase in the oxidizer concentration, provided that the concentration of 35% hydrogen peroxide ranges from 5 to 18 ml/l. The range (A) is an oxidizer-concentration range wherein the formation of a chemical conversion film is possible under the requirement (b) mentioned above. As is apparent from FIG. 2, the oxidizer concentration can be determined by measuring the oxidation-reduction potential. Further, during the chemical conversion process, an auxiliary agent containing 35% hydrogen peroxide is replenished when the oxidation-reduction potential falls to a certain value (for example 580 mV) or less, thereby stabilizing the chemical conversion process.

Both the pH value and the oxidation reduction-potential can be electrically measured, without the need to carry out a complicated chemical analysis, and is very simple and convenient. Accordingly, it is possible to automate, by means of the pH- and oxidation-reduction potential-measurements, the concentration control of a treatment bath. Since the electroconductivity is proportional to the concentration of solutes, the electroconductivity measurement can be carried out, in addition to the pH measurement.

The reactions for forming the film are explained with regard to an example, in which the metal ions are zinc and the halogen ions are chlorine. In the direct proximity of a surface of the copper-based metal substrate, the anode and cathode reactions of the formulas (6) and (7), respectively, occur, and zinc phosphate and cuprous chloride having a small solubility product are therefore produced in the form of colloid particles. The colloid particles coagulate on the surface of copper-based metallic substrate 1 to form a film 2.

Collectively describing the reaction system starting at the dissolution and ending at the film-formation, the method of present invention can be explained by the following electrochemical reaction-system on the copper surface. The anode reactions occur by the reactions (6) and (7') and the copper dissolution and the film formation proceed anodically. On the other hand, the cathode reaction occurs by the reaction (4) or (5).

The chemical conversion film according to the present invention is explained by referring to the chemical analysis thereof.

TABLE 1

| Components | A | B | C | D |
|---|---|---|---|---|
| Halogen Ions-Chlorine Ions | 15 | 45 | 63 | 125 |
| Phosphoric Acid Ions | 40 | 40 | 67 | 67 |
| Metal Ions-Zinc Ions | 25 | 30 | 80 | 157 |
| Oxidizer-35% Hydrogen peroxide water | 20 | 20 | 20 | 20 |

Unit g/l

Four kinds of chemical conversion film A, B, C, and D were produced by the bath compositions given in Table 1.

Chemical Conversion Films A and B

Figure 3:
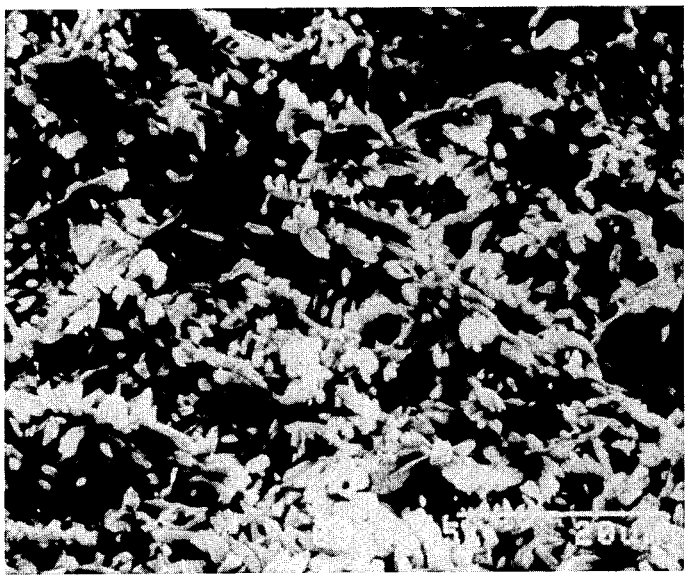
FIGS. 3, 4, 5, and 6 are scanning electronmicroscope photographs of a chemical conversion film, i.e., a film member of the copper-based metallic member according to the present invention.
Figure 4:
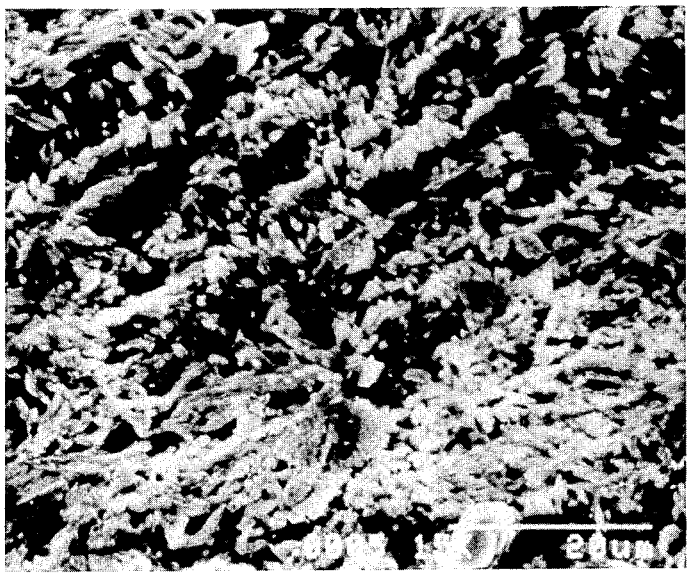

A copper plate was dipped into the solution with the composition (Table 1), contained in a beaker, and treated in the solution at 25° C. for 3 minutes. The copper plate was then rinsed with water and dried, to form the film A and B on the copper-based metallic substrate (copper plate). Referring to FIGS. 3 and 4, scanning electron-microscope photographs of the chemical conversion films A and B (magnification ×1500, photographing angle 45°) are shown, respectively. Fine crystals cover the surface of the film, and each crystal has a size from one third to one fifth that of a conventional zinc-phosphate film formed on a steel surface. The film A, therefore, has a considerably density.

Chemical Conversion Films C and D

Figure 5:
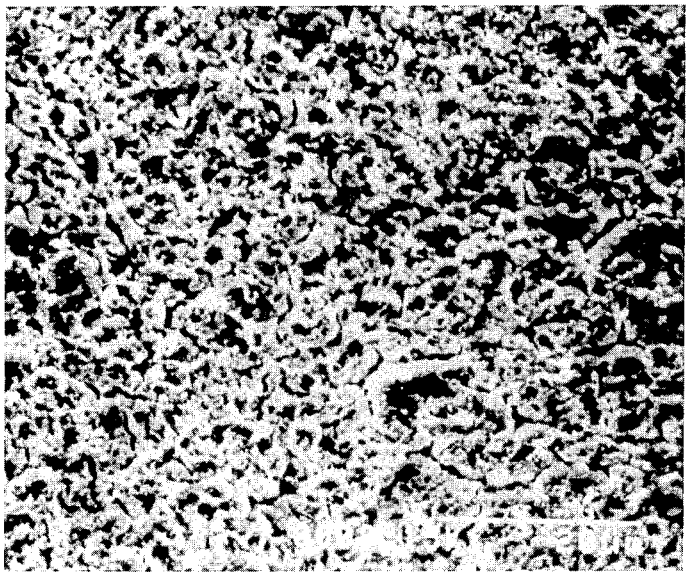
Figure 6:
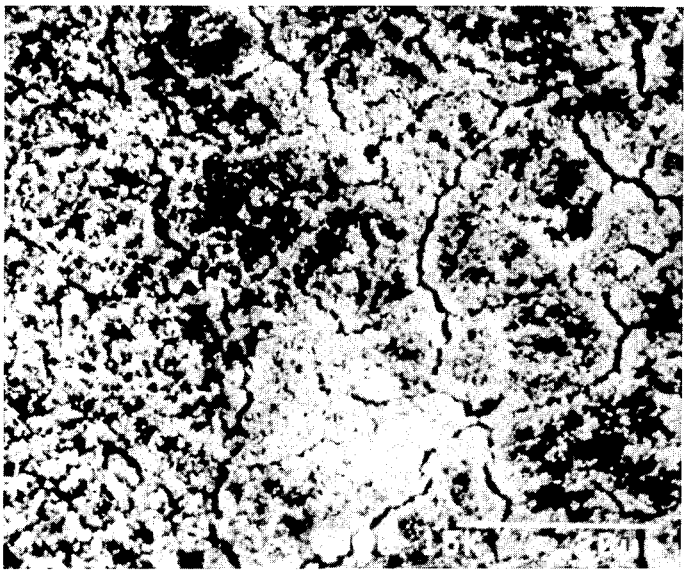

A copper part in the form of a ring, used in Example 2 described hereinbelow, was treated by a continuous chemical conversion apparatus. FIGS. 5 and 6 are scanning electron-microscope photographs (magnification ×1500, photographing angle 45°) of the chemical conversion films c and D, respectively. None of the parts shown in FIGS. 5 and 6 are discernible as crystals.

TABLE 2

| Elements | Sample C | Sample D |
|---|---|---|
| P | ++++ | ++++ |
| Zn | +++ | ++++ |
| Cu | +++ | +++ |
| Cl | +++ | +++ |
| Na | ++ | ++ |
| Ca | + | + |
| K | + | + |
| Fe | + | + |
| S | + | + |
| Si | + | + |

(++++ > +++ > ++ > +)

Figure 7:
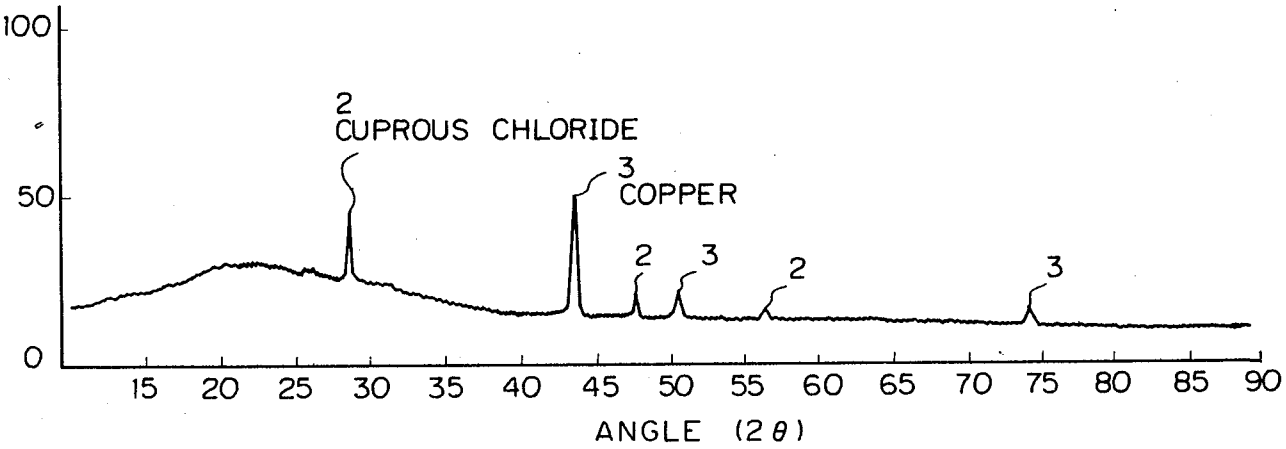
FIGS. 7 and 8 are X-ray diffraction charts (Cu-Kα) of a chemical conversion film, i.e., a film member, of the copper-based metallic member according to the present invention and show Brogg angle (2θ) on the abscissa.
Figure 8:
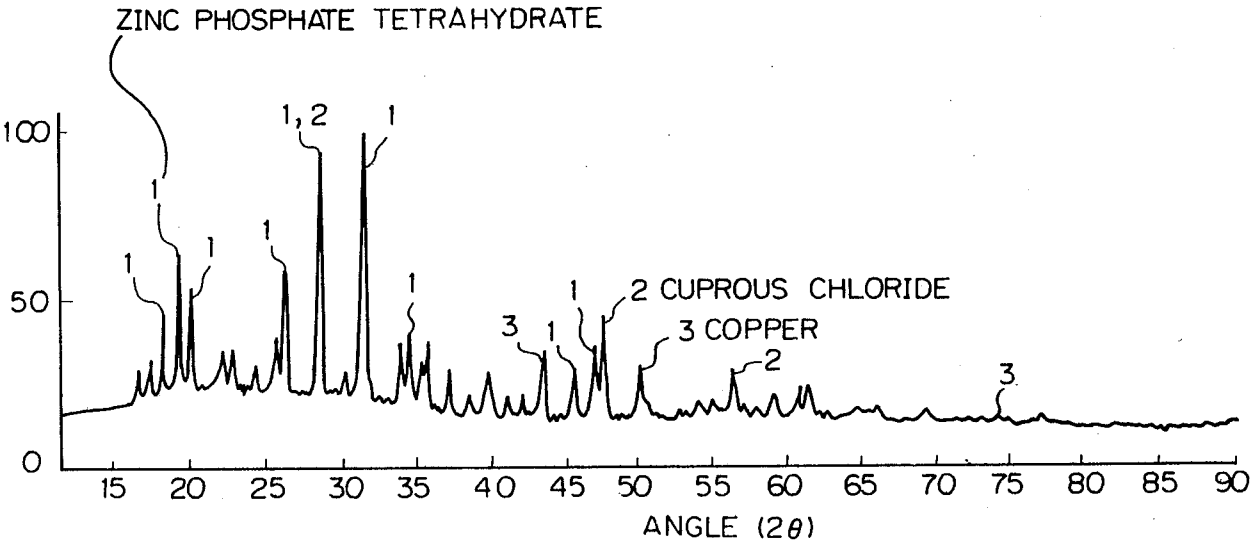

FIGS. 7 and 8 show the X-ray diffraction charts of chemical conversion films C and D, respectively. In FIG. 8, the diffraction peaks for zinc phosphate hydrate ($Zn_3(PO_4)_2 \cdot 4H_2O$) crystals (reference numeral 1), cuprous chloride (CuCl) crystals (reference numeral 2), and copper (reference numeral 3) are shown, with regard to the chemical conversion film C. In FIG. 7, however, the peaks for zinc phosphate quatre hydrate are not shown.

In Table 2, above, the results of a qualitative analysis by the X-ray fluorescence method are given. The measurement device used was a System 3080E manufactured by Rigaku Denki. As apparent from the results of qualitative analysis, the chemical conversion films C and D have virtually identical compositions and are believed to be composed of zinc phosphate and cuprous chloride. The zinc phosphate of chemical conversion film D is believed to be crystalline. However, the zinc phosphate peak is not present in FIG. 7, and hence it is believed to be not crystalline but amorphous.

The component elements of a film were then quantitatively analyzed in accordance with the method of JIS-K-0102: zinc ions by atomic-absorption spectroscopy method under rule 53.2; phosphoric acid ions by molybdenum-blue absorption metric method under rule 46.1; and chlorine ions by the silver nitratetitration method. The results are shown in Table 3.

TABLE 3

| | Film C | Film D |
|---|---|---|
| Zinc ions | 19 | 27 |
| Copper ions | 33 | 18 |
| Phosphoric acid ions | 8 | 9 |
| Chlorine ions | 19 | 6 |
| Others | 21 | 40 |

Unit-Weight %

The proportion of the elements was identical at all parts of the film.

The chemical conversion film formed on a copper-based metallic member consists of zinc phosphate and cuprous chloride which are uniformly crystalline or amorphous and which are present in a substantial amount, e.g., 50% by weight or more, of the film.

The method for forming a chemical conversion film directly on the surface of a copper-based metallic member has been deemed heretofore impossible, but is possible according to the method of the present invention. The film according to the present invention is firm and is reactive due to the presence of zinc and phosphate and cuprous chloride. The firm film property is evident from the fact that the insulation breakdown voltage under alternating current was revealed to be 200 V or more when the copper-based metallic members according to the present invention are subjected to the test of JIS-C-2110 (method for achieving short-time dielectric breakdown test of a solid insulator). The characteristic that the chemical conversion film formed on the copper surface is firm enables to apply the method according to the present invention to the production of a copper enamel conductor. This conductor is previously produced by directly forming on the copper surface, the organic film made of organic resin, since a chemical conversion film directly and firmly bonded on the copper surface could not be previously obtained. The adhesive property between the organic film and copper is however not said to be excellent, and, therefore, the organic film frequently damages. Accordingly, the method for chemical conversion treatment according to the present invention can be advantageously used for an undercoat of an organic film. Considerable improvements can be expected in enhancing the adhesion of an organic film, preventing damage to the organic film, and consequently, enhancing the insulation resistance. Note, a lubrication effect of the chemical conversion film, which is known in the case of cold-forging or pressing steel, also can be expected. The copper insulation conductor is linear or tubular and is mainly copper, but may be copper with silver or chromium incorporated therein. The copper insulation conductor may have any cross sectional shape, such as round or rectangular. The copper insulation conductor according to the present invention has, on a part of the surface or over the entire surface, a chemical-conversion layer comprised of phosphate and copper halide which may be crystalline or amorphous. The thickness of a chemical conversion layer varies in accordance with the properties required for the copper insulation conductor. When the chemical conversion film is used for a copper electric wire, a film having a thin thickness has an improved adhesion property.

The above mentioned chemical conversion layer may be formed on, for example, the entire surface of the conductor or on only a part thereof. Further, the chemical conversion layer may be formed on, for example, the outer surface of a copper tube. The insulation coating may be any coating conventionally used for the copper insulation conductors; for example, as follows:

(1) oiliness enamel composed of natural aliphatic acid and oil-soluble resin. Polyvinyl formal resin, polyurethane resin, epoxy resin, polyester resin, imide denatured polyester resin, polyester amide-imide resin, polyamide-imide resin, polyimide resin, denatured urethane epoxy resin, butyral-based resin, and other synthetic enamel varnish, and the like, are used to form a synthetic enamel layer.

(2) silk yarn, cotton yarn, polyester fiber, glass fiber, polyester glass mixed fiber, kraft paper, ganpisi, aromatic polyamide bonded fabric, polyimide film, mica, and other organic or inorganic insulative materials in the form of fiber, tape or the like are used to form a layer.

The insulative coating layer described above may be a single layer or may be a composite layer of identical or different kinds of materials. The composite layer can be formed by, for example, forming a synthetic enamel layer and then a tape- or fiber-layer.

The method for producing an insulation copper conductor according to the present invention is now described.

The copper-based metal is rolled and drawn to provide a rough-drawn wire. This wire is further drawn in the case of a wire with a round cross section, and is further rolled in the case of a wire with a square cross section. This wire provides a conductor in the form of a wire rod or tube and is brought into contact with the chemical conversion bath. The formation reactions of a film proceed at a temperature of from 20° C. to 30° C. and are completed in a short time, e.g., a few seconds or minutes. The chemical conversion treatment can be carried out batchwise, but is preferably carried out continuously in the light of the short time needed for completing the chemical reactions. In the continuous treatment, the drawn or rolled conductor can be guided successively through a degreasing tank, a chemical conversion tank, and a cleaning tank. The insulation coating layer is formed on the chemical conversion layer. The known methods per se can be applied to this formation without modification. Examples of these methods are dipping or spraying for applying and then baking organic insulative coating made of synthesized enamel varnish, or winding an insulator in the form of fiber or tape. The former method is preferred to the latter method. The conductor having a chemical conversion layer is preferably annealed before applying an insulative coating. The formations of the chemical conversion layer and insulative coating layer can be carried out continuously, so that the production as whole is continuous.

In the method for forming the chemical conversion film according to the present invention, the treating bath can be automatically controlled on the basis of the pH and oxidation-reduction potential measurements. At a low bath-temperature of from 20° C. to 30° C., the main agent and oxidizer components self-decompose only slightly. Therefore, there is little loss of the main agent and oxidizer, and thus they can be effectively used for the formation of a chemical conversion film in which sludge formation is suppressed to a negligible level. The treatment bath does not require heating, and therefore, the method according to the present invention is advantageous in the light of energy saving.

The present invention is now explained by way of Examples.

Example 1

Copper plates were used as the copper-based metallic members, and were dipped in a treating solution which contained 15 g/l of chlorine ions, 40 g/l of phosphoric ions, 25 g/l of zinc ions and 20 g/l of 35% hydrogen peroxide water. The treatment was carried out at 25° C. for 3 minutes. After the treatment, the copper plates were rinsed with water and dried, and an approximately 5μ thick chemical conversion film was obtained.

The chemical-conversion treated copper plates were sugjected to the testing method for achieving a short-time dielectric breakdown test of a solid insulator according to JIS-C-2110, and the alternating current insulation-breakdown voltage was approximately 200 V.

Epoxy-resin based, insulative paint (Trade name-Epolack-100 red rust color, produced by Tokyo Paint) was applied on the copper plates to obtain a 15μ thick film after natural drying.

The copper-based metallic members produced in this example, that is, those having an insulative coating on the chemical conversion film, were subjected to the method for achieving short-time dielectric breakdown test of a solid insulator according to JIS-C-2110. The results are shown in FIG. 9.

Comparative Example 1

The copper plates used in Example 1 were applied with same epoxy resin-based insulative coating to obtain a film thickness of 15μ after natural drying. The so prepared copper plates with an insulative coating were subjected to the measurement of insulation-breakdown voltage under alternating current. The results are shown in FIG. 9.

Figure 9:
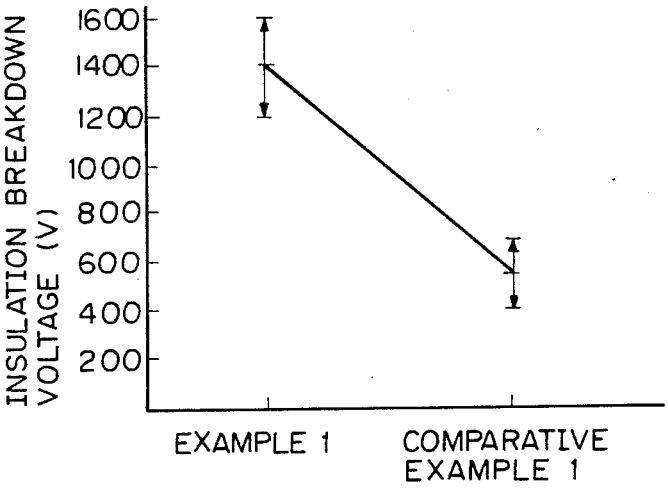
FIG. 9 is a graph indicating the insulation breakdown voltage of copper-based metallic members according to Example 1 and Comparative Example 1.

As is apparent from FIG. 9, the copper-based metallic members according to Example 1 exhibit a 1200~1600 V insulation-breakdown voltage under alternating current, which is considerably greater than the 400~700 V according to Comparative Example 1. This result shows that the copper-based metallic member with a chemical conversion film and insulative organic coating has a considerably improved electric insulative property over the prior art.

Example 2

Figure 10:
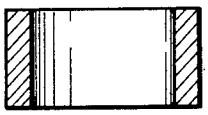
FIG. 10 shows a cross-sectional view of a ring-form copper part used in the Example 2 and 4 as well as Comparative Example 2, and 3.
Figure 11:
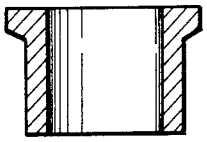
FIG. 11 shows the ring-form copper part after press-forming.
Figure 12:
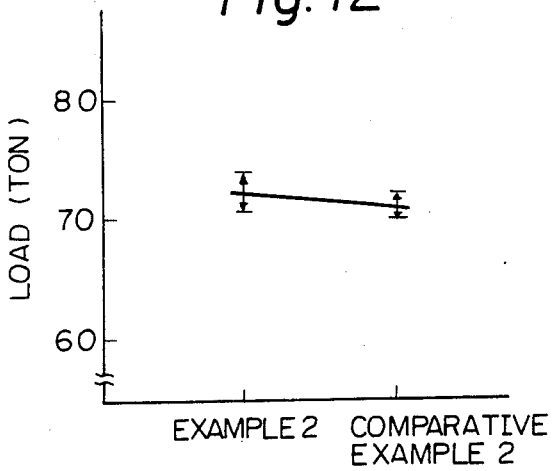
FIG. 12 is a graph indicating the load applied to the press machine for forming the copper parts after chemical conversion treatment according to Example 2 and Comparative Example 2.

The copper-based metallic members used in this example were in the form of a ring, as shown in FIG. 10, 40 mm in outer diameter, 30 mm in inner diameter, and 20.5 mm in height, intended for mounting as a part in the starter of an automobile. The copper-based metallic members were treated in a commercial, continuous chemical conversion apparatus, in which the members were pretreated by degreasing, acid-etching, and cleaning, and then chemically conversion-treated for 3 minutes, at 20° C. to 30° C., in a treating bath which contained 63 g/l of chlorine ions, 67 g/l of phosphoric acid ions, 80 g/l of zinc ions and 20 g/l of 35% hydrogen peroxide water. The formed chemical conversion film is designated as C (Table 2, Table 3, and FIG. 5). The copper-based metallic members with the chemical conversion film were further subjected, continuously, to a metal soap treatment in a metal soap tank, in which the treating agent was composed mainly of sodium stearate (produced by Nippon Parkerizing Co., Ltd. Bondaluke 235). Approximately 30,000 of the copper-based metallic members treated with metal soap were cold-forged by a press machine to produce the copper parts as shown in FIG. 11. The load applied to the press machine during the cold-forging was measured. The results are shown in FIG. 12.

Comparative Example 2

The copper parts used in Example 2 and having the shape as shown in FIG. 9 were also used in this Comparative Example but were galvanized with zinc to a plating thickness of 30μ. The copper parts were then treated, for 1 minute at 80° C., in a conventional chemical conversion bath containing 5 g/l of zinc ions, 20 g/l of phosphoric acid ions, 10 g/l of nitrate ions, 1 g/l of fluroine ions, and 0.5 g/l of nickel ions. The copper parts were then dried for 2 minutes by warm air at a temperature of 80° C. to 90° C. Thirty thousand copper parts with the so-formed chemical conversion film were treated with metal soap and press-formed as in Example 2 to produce the parts as shown in FIG. 11. The load applied to the press machine is shown in FIG. 12, in which the arrows indicate the variance of the load. As is apparent from FIG. 12, the load in Example 2 is from 71 to 74 tons and the load in Comparative Example 2 is from 70 to 72 tons, and hence the load is only slightly increased in the Example according to the present invention, compared with conventional zinc phosphating.

Example 3

A treating bath having a volume of 800 ml and containing 15 g/l of chlorine ions, 40 g/l of phosphoric acid ions, 25 g/l of zinc ions, and 20 g/l of 35% hydrogen peroxide water, was admitted in a 1 l-beaker. A copper plate was immersed in the treating bath at 25° C. for 3 minutes, followed by water rinsing and drying, to form a chemical conversion film on the copper plate surface.

The X-ray fluorescence analysis of the obtained film revealed that phosphorus, zinc, copper, chlorine and additional incidental elements are qualitively identified at all portions of the film.

As is apparent from FIG. 3 showing the electron microscope photograph of the film (magnification 1500), fine crystals cover the surface of the copper plate. The size of individual crystals is $\frac{1}{3}$~1/5 times that of zinc phosphate crystals formed on the steel surface by a conventional chemical conversion surface. The chemical conversion film according to the present invention therefore can be said to be very dense.

Example 4

Figure 13:
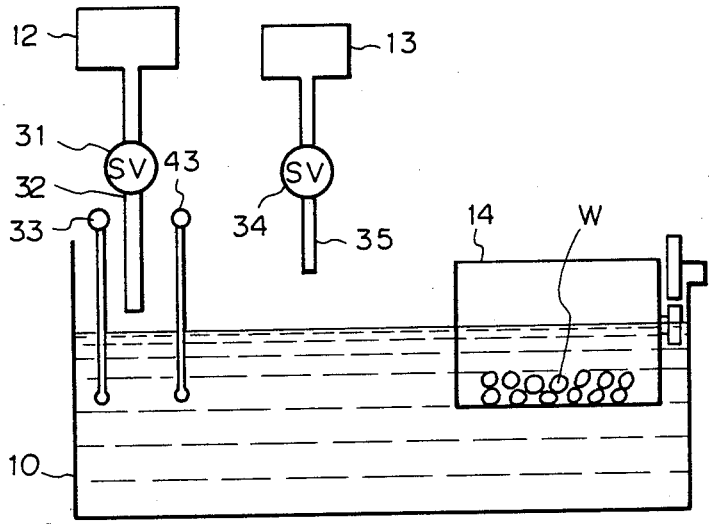
FIG. 13 is a schematic view of the chemical conversion device used in the Example 4.

FIG. 13 is a schematic drawing showing a treating tank used in the method for forming a chemical conversion film according to the present invention.

As shown in the Figure, a treating tank 10 was filled with 0.18 $m^3$ of a conversion solution. The conversion bath contained 80 g/l of zinc ions, 67 g/l of phosphoric acid ions, 63 g/l of chlorine ions, and from 20 g/l of 35% hydrogen peroxide water. The treating tank 10 was communicated with a main-agent tank 12 via a main-agent feeding pipe 32 equipped with a solenoid valve 31, and with an auxiliary tank 13 via an auxiliary feeding tank 35 equipped with a solenoid valve 34. The solenoid valves 31 and 35 were operably connected with a pH meter 33 and an ORP (oxygen reduction potential) meter 43 (silver chloride electrode-potential) dipped into the bath via an electric circuit (not shown) which could be closed by the pH meter 33 and the ORP meter 43. The solenoid valve 31 opened when the pH of the conversion bath measured by the pH meter 33 increased to 1.4 or more, thereby feeding the main agent from the main-agent tank 12 into the conversion bath. The solenoid valve 31 closed when the pH of the conversion bath measured by the pH meter 33 decreased to 1.4 or less. The solenoid valve 34 opened when the ORP meter 43 (a silver chloride electrode) showed 600 mV or less in terms of the silver chloride electrode potential, thereby feeding the auxiliary from the auxiliary tank 13 into the conversion bath. The solenoid valve 34 closed, when the ORP meter 43 (a silver chloride electrode) showed 600 mV or more in terms of the silver chloride electrode potential.

To replenish the main agent, an acidic aqueous solution, which contained 320 g/l of zinc ions, 280 g/l of phosphoric acid ions, and 200 g/l of chlorine ions, was fed from the main-agent feeding conduit 32 at a rate controlled to 50 ml/minute. To replenish the auxiliary agent, a 35% hydrogen peroxide containing an aqueous solution was fed through the auxiliary agent-feeding conduit 35 at a speed of 50 ml/minute. The workpieces W were caused to drop into the barrel 14 which was rotated at a speed of from one to five turns per minute.

The workpieces W were ring-formed copper parts for an automobile starter, 40 mm in outer diameter, 30 mm in inner diameter, and 20.5 mm in height, as shown in FIG. 10. A hundred copper parts contained in the barrel (50) were successively subjected, in the apparatus schematically shown in FIG. 15, to (1) degreasing, in the degreasing tank (a), with an aqueous alkaline solution at 55° C. for 2 minutes; (2) rinsing, in the rinsing tank (b), with hot water at 55° C. for 0.5 minutes; (3) rinsing, in the rinsing tank (c), with normal temperature-water at 20° C.~30° C. for 0.5 minute; (4) etching, in the etching tank (d), with acidic etching solution at normal temperature for 0.5 minute; (5) rinsing, in the rinsing tank (e), with normal temperature water for 0.5 minute; (6) chemical-conversion treating, in the tank (f) described with reference to FIG. 13, at 20° C.~30° C. for three minutes; (7) rinsing, in the rinsing tank (g), with the normal-temperature water for 0.5 minute; (8) rinsing, in the rinsing tank (h) with hot water at 70° C.~80° C. for 0.5 minutes; and (9) drying, in the drying furnace (i), with warm air at 80° C.~90° C. for 2 minutes.

The so-formed chemical conversion films weighed from 5 to 10 g/m$^2$ and were 10 μm thick.

The chemical analysis of the films indicated that they consisted of 19% by weight of zinc, 19% by weight of chlorine, 33% by weight of copper, 8% by weight of phosphoric acid ions, and 21% of hydrate as water. This composition was identical at every part of the films, that is, the films were virtually homogeneous. Referring to FIG. 5 showing the electron microscope photograph of one of the films at a magnification of 1500, the crystals as shown in FIG. 3 are not detected. The X-ray diffractometry of this film indicated no great peak identifying zinc phosphate (FIG. 7, sample C), while the X-ray fluorescence analysis and absorptiometric analysis (Table 2, sample C) detected the zinc ions and phosphoric acid ions, as described above. It is therefore deduced that, in the films of this example, the zinc phosphate is amorphous.

In the chemical conversion tank, 1200 copper parts were treated per hour and 30000 parts were treated in total. During this treatment, the treatment bath was automatically controlled, no sludge was formed, and no abnormality occurred in the treating bath.

Figure 15:
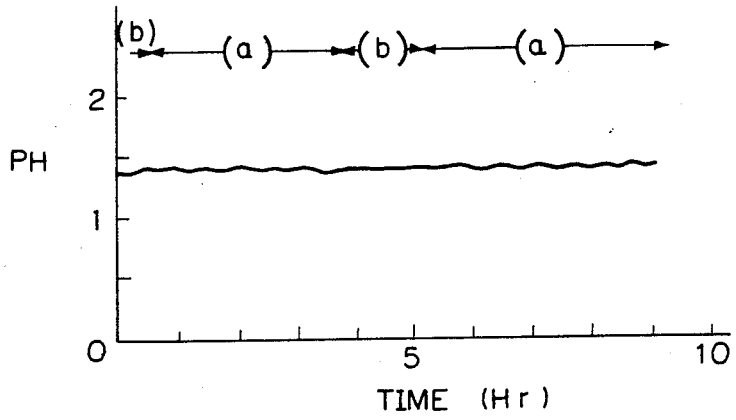
FIG. 15 is a part of the pH recording chart showing the pH of the treating liquid used in Example 4.

The pH control system used was manufactured from a pH electrode (produced by Denki Kagaku Keisoku Co., Ltd. under the name of BHC-76-6045-type pH electrode) and a pH recorder (produced by Denki Kagaku Keisoku Co., Ltd. under the name of HBR-92-type recorder). Part of the pH recording chart is shown in FIG. 15. The abscissa and the ordinate in FIG. 15 indicate the time and the pH, respectively. Each section in the ordinate corresponds to one hour.

Replenishment of the main agent was started at the beginning of the time period "a" and was stopped at the end of the time period "a". Replenishment of the main agent was started and stopped when the pH rose above 1.4 and fell below 1.4, respectively. In the time period (b), no workpieces are loaded in the treating bath. From the comparison of the time periods (a) with (b), it is apparent that pH virtually does not vary during the chemical conversion due to pH control in the time period (a).

The ORP control system was manufactured from an ORP meter (produced by Denki Kagaku Keisoku Co., Ltd. under the name of BHC-76-6026-type metal electrode silver chloride electrode) and an ORP control recorder (produced by Denki Kagaku Keisoku Co., Ltd. under the name of HBR-94-type control recorder).

A silver chloride electrode was conventionally used, and its potential can be converted to the normal hydrogen electrode potential as follows.

$$E\,(NHE) = E(AgCl) + 206 - 0.7(t-2.5)\ mV \quad \ldots (14)$$

E (NHE) . . . normal hydrogen electrode potential

E (AgCl) . . . 3.33M KCl=AgCl electrode potential t . . . temperature (°C.)

Figure 16:
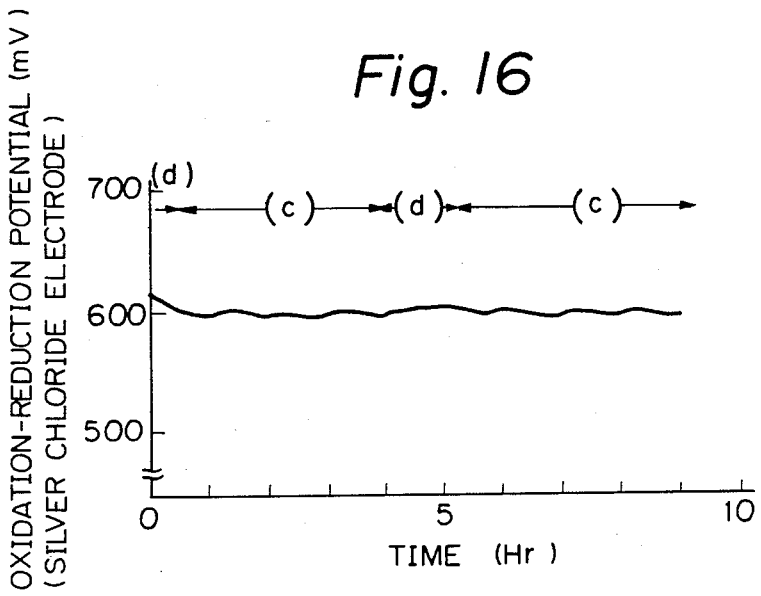
FIG. 16 is a part of the oxidation-reduction potential recording chart with regard to the treating liquid used in Example 4.

In FIG. 16 the abscissa and ordinate indicate the time and the oxidation-reduction potential (silver chloride electrode), respectively. Also, in FIG. 16, the time periods (c) and (d) indicate the loading and no loading of the workpieces in the treating bath. In both the time periods (c) and (d), the feed of auxiliary agent is automatically controlled in such a manner that the replenishment of the auxiliary agent is initiated and stopped at the oxidation-reduction potential (silver chloride electrode potential) of less than 600 mV and more than 600 mV, respectively. As a result, the oxidation-reduction potential of the treating bath was controlled within the range of 600±10 mV (silver chloride electrode potential).

In this example, the properties of a chemical conversion film according to the present invention are compared with the conventional zinc galvanized and then chemically converted film.

Figure 14:
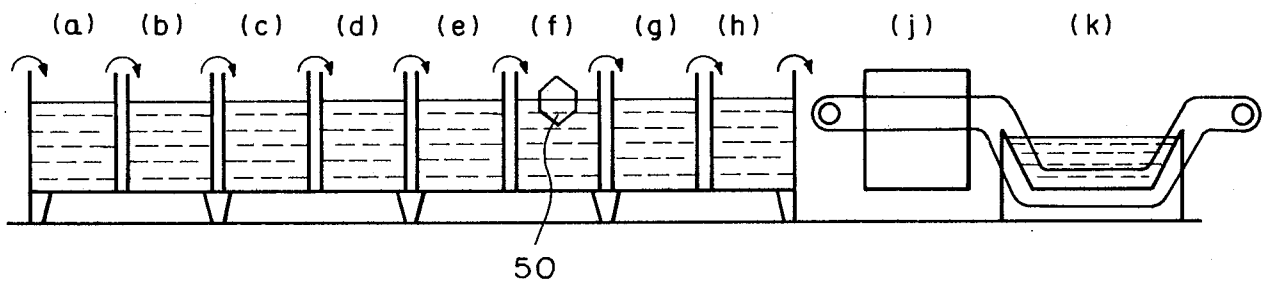
FIG. 14 shows a chemical conversion system including the device shown in FIG. 13, including a cleaning device and a metal-soap treating device.

The chemical conversion film according to the present invention was produced by the same method as described above except that the drying in the drying furnace (j) (FIG. 14) was omitted and instead the metal soap treatment was carried out in the treating tank (k) at 80° C. for 3 minutes. The metal soap was of the same kind as in Example 2 (Nippon Parkerizing Co., Ltd. Bondalube 235). Approximately 30,000 ring-form copper parts as shown in FIG. 10, treated with metal soap, were cold-forged to form the members as shown in FIG. 11. The load applied to the press machine during the cold-forging is shown in FIG. 17.

For comparison purposes, the ring-formed copper parts as shown in FIG. 10 were zinc-galvanized, and were then chemical-conversion treated, dried, and metal-soap treated as in Comparative Example 2. The load applied to the press machine during the cold forging of approximately 30,000 copper tubes treated as above is shown in FIG. 17 as CONVENTIONAL.

For comparison purposes, a chemical conversion film was formed by the same procedure as in the above described method of the present invention except for the metal soap treatment, which was omitted. The load applied to the press machine during the cold forging (below simply "load") of several copper rings treated as above is shown in FIG. 17 as COMPARATIVE. In FIG. 17, the arrow marks indicate the variance in load.

Figure 17:
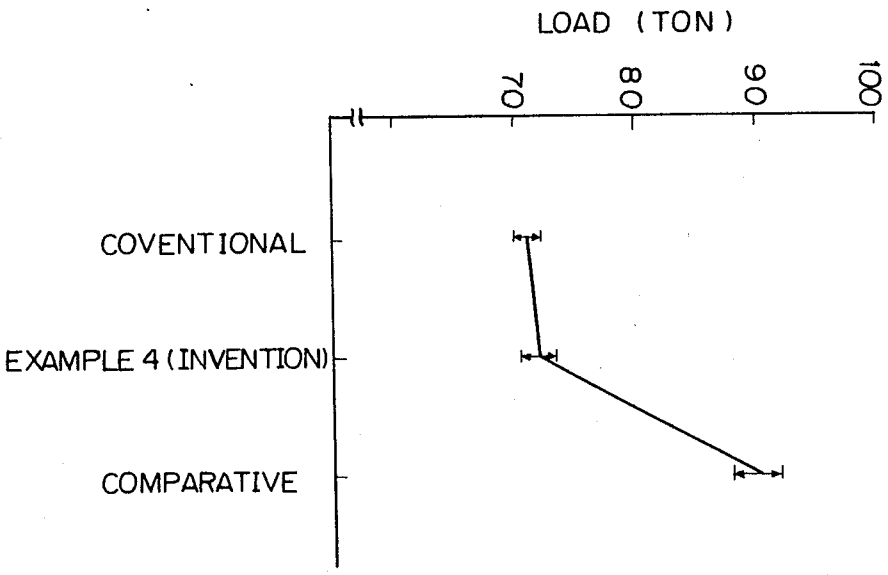
FIG. 17 is a graph indicating the load applied to the press machine for forming the copper parts which are chemically conversion treated according to Example 4, in which the samples according to the presentive invention and conventional and comparative methods are tested.

As is apparent from FIG. 17, the load in the case of the present invention is only slightly higher than the load in the CONVENTIONAL case. Such an increase of the load is within an acceptable level for using the copper-based metallic member according to the present invention as the forged part or as a forging workpiece. Note, the copper-based metallic member should be subjected to a lubricating treatment such as the metal soap treatment when used as forging workpiece, thereby lessening the load.

The conventional method with three steps, i.e., zinc-galvanizing, chemical conversion, and metal-soap treatment can be replaced with two steps of i.e., chemical conversion treatment and metal soap treatment in the present invention.

Example 5

Figure 18:
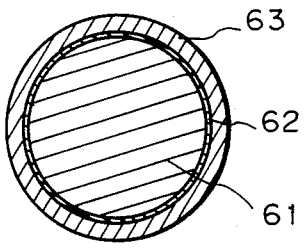
FIG. 18 is a cross sectional view of a representative insulated electrical copper conductor according to the present invention.
Figure 19:
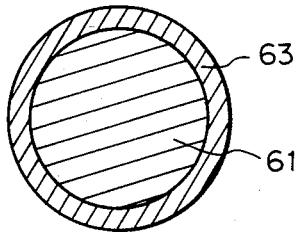
Fig. 19 PRIOR ART
FIG. 19 is a cross sectional view of a representative insulated electrical copper conductor according to the prior art.

A linear conductor composed of copper, having a round cross section, a diameter of 1.2 mm, and a length of 700 mm and obtained by wire-drawing roughly drawn wire, was degreased by trichloroethylene and the obtained copper conductor dipped into a chemical conversion treatment bath containing 30 g/l of zinc ions, 30 g/l of chlorine ions, 40 g/l of phosphoric acid ions, and 25 g/l of 35% hydrogen peroxide water, at a temperature of 25° C. for three minutes. Thus, a chemical conversion film consisting of zinc phosphate and copper chloride was formed on the entire surface of the workpiece. The linear conductor was immersed in water having a room temperature for 30 secs. This was repeated and then followed by water rinsing and drying for 3 minutes by hot air having a temperature of 80° C. to 100° C. Then the linear conductor having the chemical conversion film was immersed in epoxy resin varnish (#TVA-1410 produced by Toshiba Chemical Co.). The conductor was then dried naturally in air for 48 hours to form an insulation coating later, with the result that copper electric wires with an insulation layer according to the present invention were obtained. FIG. 18 shows a cross-section of the obtained workpiece. As shown in FIG. 18, the linear conductor 61 is covered with a chemical conversion film 62 and an insulation film 63. Three examples of the copper electric wire with insulation were produced. The film thickness of the wires, formed by the thicknesses of the chemical conversion film and epoxy resin coating layer, was 20 $\mu$m$\pm$10 $\mu$m.

Comparative Example 3

A conductor having the same shape as that used in Example 5 was used. After degreasing by trichloroethylene, the conductor was coated with epoxy resin varnish and dried without a chemical conversion treatment to form an insulation coating layer. Thus, three conventional copper electric wires with an insulation layer were obtained. The thickness of the insulation coating layer was 20 $\mu$m$\pm$10 $\mu$m. The adhesion property of the organic coating to copper was investigated by peeling the organic coating from the copper electric wire with a finger nail. Thus, it was found that the organic coating in Example 5 has improved adhesion properties compared to that in Comparative Example 3. Namely, the organic coating in Example 5 could not be easily peeled away.

The adhesion property of the insulation coating with a copper based metal according to the present invention can be further improved by using a phosphate based chemical conversion film, and thus it is expected that damage to the insulation coating layer during winding can be prevented. Further, an effect whereby crazing is prevented is expected.

The fields of utilization of the present invention are now described.

Since the chemical conversion film according to the present invention has improved rust-resistance and insulation property, and also has an improved property as a paint undercoating, it can be used for the conduction copper wire with a synthetized resin coating.

The copper-based metallic member having a chemical conversion film previously was used only in limited fields, but can be broadly used by the provision of present invention; even in such various fields of industry using chemically converted iron-based metallic members.

The copper-based metallic member including a lubricating film can be easily cold-worked and can have various shapes, so that its field of utilization is significantly broadened.

I claim:

1. A copper-based metallic member comprising a substrate consisting of a copper-based metallic material; and a chemical conversion film layer formed on at least a portion of the surface of the substrate, said chemical conversion film layer comprising at least one metal phosphate selected from phosphates of zinc, manganese, iron, calcium and magnesium, and at least one copper halide selected from the group consisting of cuprous chloride, cuprous bromide and cuprous iodide.

2. A copper-based metallic member according to claim 1, wherein said conversion film layer substantially consists of said metal phosphate and said cuprous halide.

3. A copper-based metallic member according to claim 1, wherein said chemical conversion film layer is formed by applying a general electrochemical corrosion reaction to said copper-based substrate.

4. A copper-based metallic member according to claim 1, 2 or 3, wherein said copper-based metallic member is in the form of a wire.

5. A copper-based metallic member according to claim 1, 2 or 3, wherein said copper-based metallic member is in the form of a plate.

6. A copper-based metallic member according to claim 1, 2, 3, wherein said copper-based metallic member is in the form of a tube.

7. A copper-based metallic member according to claim 1, wherein said substrate is made of a copper-based alloy.

8. A copper-based metallic member comprising a substrate consisting of a copper-based metallic material and a chemical conversion film layer formed on at least a portion of the surface of the substrate, said chemical conversion film layer consisting essentially of:

(a) a metal phosphate selected from the group consisting of zinc, magnesium, iron, calcium and magneisum phosphates; and (b) a cuprous halide selected from the group consisting of cuprous chloride, bromide and iodide.

* * * * *